US006507179B1

(12) United States Patent
Jun et al.

(10) Patent No.: US 6,507,179 B1
(45) Date of Patent: Jan. 14, 2003

(54) LOW VOLTAGE BANDGAP CIRCUIT WITH IMPROVED POWER SUPPLY RIPPLE REJECTION

(75) Inventors: Chen Jun, Allen, TX (US); Hoon Siew Kuok, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/995,360

(22) Filed: Nov. 27, 2001

(51) Int. Cl.[7] ..... G05F 3/16
(52) U.S. Cl. ..... 323/313; 323/315
(58) Field of Search ..... 323/313, 314, 323/315, 316; 327/539, 540

(56) References Cited

U.S. PATENT DOCUMENTS 5,512,817 A 4/1996 Nagaraj
6,147,548 A * 11/2000 Doyle ..... 327/539
6,184,743 B1 2/2001 Swart
6,198,266 B1 * 3/2001 Mercer ..... 323/316
6,255,807 B1 7/2001 Doorenbos et al.
6,281,743 B1 * 8/2001 Doyle ..... 327/539
6,285,244 B1 9/2001 Goldberg
6,294,902 B1 9/2001 Moreland et al.

OTHER PUBLICATIONS

"Curvature Compensated BiCMOS Bandgap with 1 V Supply Voltage", P. Malcovati, F. Maloberti, M. Pruzzi and C. Fiocchi, Published date not available, 4 pages.

* cited by examiner

*Primary Examiner*—Adolf Deneke Berhane
(74) *Attorney, Agent, or Firm*—Ronald O. Neerings; Wade J. Brady, III; Frederick J. Telecky, Jr.

(57) ABSTRACT

Methods and apparatus are disclosed for reducing output ripple voltages in bandgap voltage reference circuits. Ripple rejection circuitry is connected to a supply voltage and a first control signal, such as from an amplifier. The ripple rejection circuitry provides a second control signal representative of a difference between the supply voltage and the first control signal. The second control signal is then used to generate a reference voltage output. The incorporation of the supply voltage component in the second control signal operates to reduce or suppress the effects of power supply ripple on the bandgap voltage output.

21 Claims, 6 Drawing Sheets

LOW VOLTAGE BANDGAP CIRCUIT WITH IMPROVED POWER SUPPLY RIPPLE REJECTION

FIELD OF INVENTION

The present invention relates generally to electrical reference voltage circuits and more particularly to methods and apparatus for reducing output voltage ripple in bandgap reference circuits.

BACKGROUND OF THE INVENTION

Reference voltages are used in a wide variety of analog circuits, including wireless communications devices, memory devices, voltage regulators, conversion circuits, and others, to provide steady DC reference voltages. The reference voltages are used for biasing various circuit components, providing references to comparator circuit inputs, and for calibration circuits, and the like. For instance, in designing various analog circuits, such as digital to analog converters, voltage regulators, or low drift amplifiers, it is necessary to establish an independent, stable bias reference. Typically this reference is a voltage, which provides a substantially constant output voltage regardless of changes in input voltage, output current, or temperature, although current references are sometimes used.

Voltage reference circuits are sometimes designed using reference diodes such as Zener diodes, where a reference voltage is established across a biased diode and buffered for use in other circuitry. Over the past several decades, however, so-called "bandgap" voltage reference circuits have been predominantly used rather than Zener diode type approaches, due to superior reference voltage stability with changing temperature. Bandgap voltage reference circuits take advantage of temperature coefficients associated with semiconductor device physical properties so as to provide a reference voltage generally insensitive to thermal variations, at least with respect to first order effects. Such bandgap circuits are well known and many variations are in use, for example, in which second order non-linear effects are addressed or otherwise compensated for in providing stable reference voltages. The physical characteristics of semiconductor devices used to implement bandgap circuit designs are derived from the voltage gap between the conduction band and the valence band of the semiconductor material (e.g., silicon), and hence the term "bandgap" reference.

In a bandgap reference circuit, a signal corresponding to a base-emitter voltage ($V_{BE}$) is summed with a signal corresponding to the difference in base-emitter voltages of two diode-connected transistors ($\Delta V_{BE}$) of different emitter sizes in producing a bandgap output reference voltage. The first component $V_{BE}$ is known to have a negative temperature coefficient, whereas the latter component $\Delta V_{BE}$ has a positive temperature coefficient. Thus, the bandgap type reference circuit utilizes predictable temperature drift properties of opposite polarities with appropriate scaling, by which the effects of the two opposite-polarity drifts are made to cancel, resulting in a nominally zero temperature coefficient output voltage level.

In a bipolar transistor, the temperature dependence of the base-emitter voltage drop $V_{BE}$ exhibits a negative temperature coefficient of about −2 mV per degree C. Conversely, the temperature dependence of $\Delta V_{BE}$ between two transistors is proportional to the absolute temperature through the thermal voltage $V_T$, with $V_T$ equal to kT/q, where k is Boltzmann's constant, T is the absolute temperature in degrees Kelvin, and q is the electron charge. The $\Delta V_{BE}$ term accordingly exhibits a positive temperature coefficient, and is sometimes referred to as a Proportional T o Absolute Temperature (PTAT) component. In typical bandgap circuits, one or both of these components, usually voltage signals, are scaled and the scaled signals are then subtracted in order to provide a temperature independent bias voltage, with the opposite polarity temperature coefficients canceling one another. In this manner, bandgap reference circuits compensate the negative temperature coefficient of a bipolar transistor's base-emitter voltage, $V_{BE}$, with the positive temperature coefficient of the thermal voltage $V_T$ associated with the difference in base-emitter voltages of two diode-connected transistors $\Delta V_B$.

In addition to being temperature independent, voltage reference circuits should also provide a substantially constant output voltage in the presence of changing supply voltage levels and/or changing loading conditions. In this regard, the basic bandgap reference circuit designs suffer from output noise or ripple voltages caused by ripple or noise components in the power source supplying the bandgap circuit. One measure of the ability of a reference circuit to suppress or reject such supply ripple voltages is referred to as the power supply ripple rejection (PSRR). Within the context of modem high-speed digital devices, noise immunity or suppression is becoming more and more important, where fast switching of digital circuitry (e.g., in wireless communications and/or portable computational devices) may impart noise onto a supply voltage (e.g., such as a battery) providing power to the voltage reference circuit. Cascode devices are sometimes added to bandgap circuits to increase the PSRR (e.g., by reducing the amount of output ripple). However, cascode devices, if so employed, must be connected in series with other reference circuit components, between the supply voltage and ground. As a result, such cascode techniques reduce the voltage headroom available in the circuit as a whole. Another approach is to provide a pre-regulated power supply for the bandgap circuit. However, the circuit associated with the pre-regulation will consume more power, area and increase the complexity of the whole system.

In this regard, there is a continuing trend toward low power, low voltage systems, for example, such as wireless communications devices, portable computational devices, and the like, in which stable reference voltage circuits are needed. For instance, many modem wireless systems are being designed for operation using batteries supplying as low as 1.3 volts DC. In such applications, therefore, ripple reduction techniques involving cascode circuitry may be impractical or unworkable, such as where the bandgap reference output voltage is about 1.2 volts DC. Thus, there is a need for improved bandgap voltage reference circuits and techniques by which output ripple can be reduced without adversely impacting current and future supply voltage headroom requirements. Furthermore, as the power consumption constraints become more stringent, it is also desirable to provide reference circuits, such as bandgap systems with improved noise immunity, without significantly increased power consumption.

SUMMARY OF THE INVENTION

The following presents a simplified summary in order to provide a basic understanding of some aspects of the invention. This summary is not an extensive overview of the invention. It is intended neither to identify key or critical elements of the invention nor to delineate the scope of the invention. Rather, the primary purpose of the summary is to present some concepts of the invention in a simplified form as a prelude to the more detailed description that is presented later.

The invention involves reducing output ripple voltages in bandgap voltage reference circuit using ripple rejection circuitry. The ripple rejection circuitry represents a subtractor that has two input control signals (the first one is from the output of an error amplifier and the second one is from the power supply). The output of the ripple rejection circuitry is simply the subtraction of these two control signals. The inclusion of the supply voltage component in the control signal advantageously provides for improved power supply ripple rejection (PSRR). The ripple rejection circuitry, moreover, does not adversely affect the supply voltage headroom in the bandgap circuitry, and further does not significantly increase power consumption, thus being particularly applicable in low power, low voltage applications. The invention thus represents an advancement over conventional bandgap reference circuits, finding utility in wireless communications and portable computational devices, as well as any circuitry where stable reference voltages are needed.

One aspect of the present invention involves a bandgap circuit comprising two circuit branches electrically connected between a supply voltage and the ground. The bandgap circuit comprises an input circuit such as having two bipolar devices, three resistors, an amplifier, a ripple rejection circuit and a current mirror circuit. Through the amplifier, two bipolar devices generate a $\Delta V_{BE}$ signal, which is sensed by a resistor. The output of the amplifier is connected to the ripple rejection circuit, which may comprise a subtractor. The output of the ripple rejection circuit is the subtraction or difference of a supply voltage and the amplifier output voltage. The output of the ripple rejection circuit, which is connected to a pair of current mirrors, operates to modulate the currents through two circuit branches in bandgap circuit and keep these current the same.

The invention thus provides a bandgap circuit comprising two circuit branches electrically connected between a supply voltage and a ground, with an input circuit, an amplifier, a ripple rejection circuit, and a mirroring circuit. The input circuit provides input voltages at first and second input voltage nodes, for example, which may represent first and second base-emitter voltages associated with first and second diode-connected transistors having different emitter sizes. The amplifier senses the input voltages and provides a first control signal. The ripple rejection circuit provides a second control signal representative of a difference between the supply voltage and the first control signal, and the mirroring circuit provides currents to the circuit branches according to the second control signal, wherein the first current provides the reference voltage at a reference voltage node in the first circuit branch. In one implementation, the mirroring circuit comprises first and second PMOS transistors connected in the first and second circuit branches, respectively, and the ripple rejection circuit comprises a subtractor including two NMOS transistors providing the second control signal representing the difference between the supply voltage and the first control signal.

The PMOS transistors, in turn, receive the second control signal from the NMOS transistors and accordingly provide the currents to the circuit branches. For example, one NMOS transistor may comprise a drain terminal connected to the supply voltage, a gate terminal connected to the supply voltage, and a source terminal connected to the mirroring circuit, and the other NMOS transistor may comprise a drain terminal connected to the source terminal of the first NMOS transistor, a gate terminal connected to the amplifier output terminal, and a source terminal connected to ground. In this manner, the second control signal provided to the PMOS gates is the difference between the supply voltage and the first control signal, by which the currents provided by the PMOS transistors will not be affected by power supply ripple or noise.

Another aspect of the invention provides a system for reducing output ripple voltages in a bandgap voltage reference circuit. The system comprises a first MOS transistor with a drain and a gate connected to a supply voltage, and a source providing a control signal to a mirroring circuit. A second MOS transistor is provided, which comprises a drain connected to the source of the first MOS transistor, a gate terminal connected to an amplifier, and a source connected to ground. The gate of the second MOS transistor receives the amplifier output signal. The system produces the control signal representing a difference between the supply voltage and the amplifier output signal, by which the effects of supply voltage ripple or other power source noise is not transferred to the bandgap reference output.

Yet another aspect of the present invention provides a method of reducing ripple voltage in a bandgap voltage reference system. The method provides a feedforward supply voltage to the control terminal of the current mirror through a summation circuit, such as a subtractor. Thus, when the input terminals of the current mirror varies with supply voltage, the control terminals of the current mirror are adjusted in the same direction. As a result, the current in two branches of the bandgap circuit are insensitive to supply noise.

The provision of the control signal to the current mirrors of the bandgap circuit may be accomplished in a variety of ways. In one implementation, the second control signal is provided by connecting the drain and gate of a first MOS transistor to the supply voltage, connecting the source of the first MOS transistor and the drain of a second MOS transistor to a mirroring circuit in the system, connecting the gate of the second MOS transistor to receive the control signal from the amplifier, connecting the source of the second transistor to ground, and providing the control signal at the source of the first MOS transistor and the drain of a second MOS transistor representing a difference between the supply voltage and the first control signal.

To the accomplishment of the foregoing and related ends, the following description and annexed drawings set forth in detail certain illustrative aspects and implementations of the invention. These are indicative of but a few of the various ways in which the principles of the invention may be employed. Other aspects, advantages and novel features of the invention will become apparent from the following detailed description of the invention when considered in conjunction with the drawings.

DETAILED DESCRIPTION OF THE INVENTION

Figure 1:
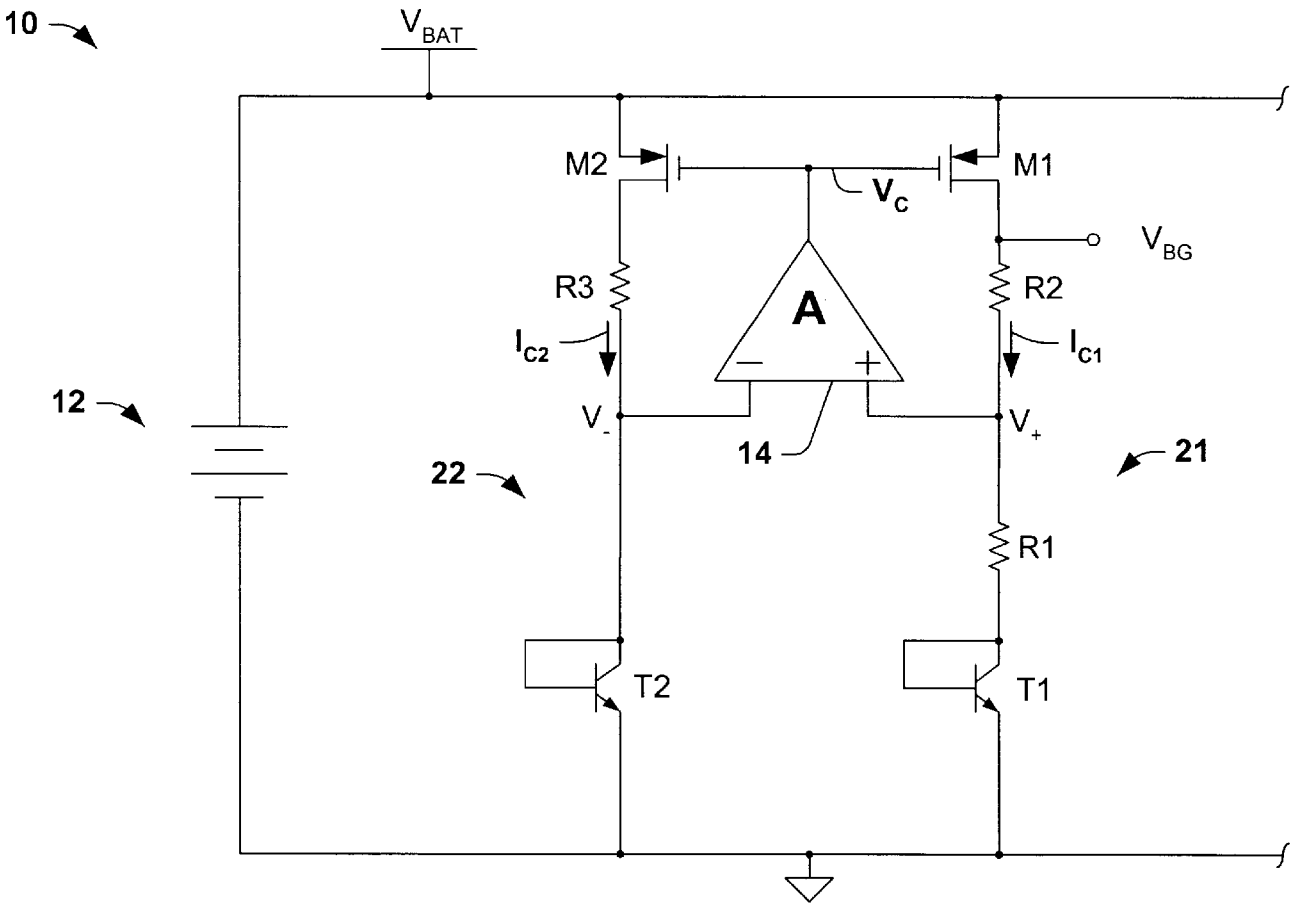
FIG. 1 (PRIOR ART)
FIG. 1 is a schematic diagram illustrating a conventional bandgap voltage reference circuit in which supply voltage ripple or noise is transferred to the bandgap voltage reference output terminal.

The present invention will now be described with reference to the attached drawings, wherein like reference numerals are used to refer to like elements throughout. The invention relates to bandgap reference circuits and systems, as well as methods for reducing power supply ripple therein, by which reference voltage stability may be improved without sacrificing voltage headroom, and without significantly increasing power consumption or component count. Thus, the invention is particularly attractive for low power, low voltage applications such as wireless communications and/or portable computational devices. However, it will be appreciated that the invention is not limited to these applications, and that one or more aspects of the present invention may alternatively be employed in association with any type of circuitry in which stable reference voltages are desired.

Referring now to the drawings, FIG. 1 illustrates a conventional bandgap voltage reference circuit 10 powered by a battery 12 supplying a voltage $V_{BAT}$.

The circuit 10 includes first and second circuit branches 21 and 22 extending between the supply voltage $V_{BAT}$ and ground, with first and second input voltage nodes $V_+$ and $V_-$, respectively. The branches 21 and 22 include diode-connected bipolar transistors T1 and T2, respectively, having different emitter areas or sizes, whereby the base-emitter voltages thereof are different when equal currents flow through the branches 21 and 22. The first circuit branch 21 comprises first and second resistors R1 and R2 with R2 connected between $V_+$ and a bandgap reference voltage output node $V_{BG}$, and resistor R2 connected between the $V_+$ node and the transistor T1. A first MOS transistor M1 (e.g., PMOS) is connected in the first branch 21 between the supply voltage $V_{BAT}$ and the bandgap output node $V_{BG}$ so as to provide a first branch current $I_{C1}$ in a controlled fashion according to a control signal $V_C$ at the gate terminal thereof.

The second circuit branch 22 comprises a third resistor R3 connected between a second MOS transistor M2 (e.g., PMOS) and the second bipolar transistor T2 (e.g., at node $V_-$), wherein the transistor M2 delivers a second branch current $I_{C2}$ according to the control signal $V_C$. An amplifier (e.g., op-amp) 14 is provided in the circuit 10 having a non-inverting input terminal connected to the $V_+$ input voltage node and an inverting input terminal connected to the $V_-$ input voltage node. The amplifier 14 provides the control signal $V_C$ at an output terminal according to the difference between the voltages $V_+$ and $V_-$ as well as a gain A, wherein the control signal $V_C=A(V_+-V_-)$ by virtue of the feedback through resistors R2 and R3.

In operation, the circuit 10 provides a bandgap reference output voltage at the node $V_{BG}$ which is generally stable with respect to temperature variations. The amplifier 14 provides the signal $V_C$ to the gates of the PMOS transistors M1 and M2, by which the currents $I_{C1}$ and $I_{C2}$ in the first and second circuit branches 21 and 22 are equal. The second input voltage at node $V_-$ represents a base-emitter voltage $V_{BE2}$ associated with the diode-connected transistor T2, which varies with temperature and is generally proportional to the absolute temperature in degrees Kelvin. The amplifier 14 operates in closed-loop fashion to make the voltages at $V_+$ and $V_-$ equal, such that $V_-=V_{BE2}=V_+=V_{BE1}+_{C1}*R1$ in equilibrium (assuming the loop-gain is infinitely large, otherwise $V_+=V_-+VjA$). Thus, the output reference voltage $V_{BG}=V_++I_{C1}*R2=V_{BE1}+I_{C1}*(R1+R2)$.

Although the circuit 10 of FIG. 1 provides a stable output reference voltage $V_{BG}$ with respect to temperature, the circuit 10 is subject to noise or ripple voltages at the output $V_{BG}$ resulting from ripple or noise on the supply voltage $V_{BAT}$. For instance, in wireless or other digital systems, high-speed digital circuitry (not shown) may also be connected so as to receive power from $V_{BAT}$. Switching in such digital circuitry may cause noise on the supply voltage $V_{BAT}$. In order to appreciate the dependency of the output $V_{BG}$ on the supply voltage $V_{BAT}$, it is noted in the circuit 10 that the first input voltage $V_+$ is given by the following equation (1):

$$V_+=V_-+(1/A)V_c=I_{C1}R1+V_{BE1}=I_{C1}R1+Vt\ In(I_{C1}/I_{S1}), \tag{1}$$

where $I_{S1}$ is the saturation current for the bipolar transistor T1 and Vt is the thermal voltage given by the following equation (2):

$$Vt=KT/q. \tag{2}$$

In equation (2), K is the Boltzmann constant (e.g., 1.38 $E^{-23}$ Joules per degree Kelvin), T is the absolute temperature in degrees Kelvin, and q is the magnitude of the electron charge in the device T1. In addition, it is noted that $V_-$ is the base-emitter voltage $V_{BE2}$ of the transistor T2, and is given by the following equation (3):

$$V_-=Vt\ In(I_{C2}/I_{S2}). \tag{3}$$

Because in equilibrium the currents $I_{C1}$ and $I_{C2}$ are equal, (e.g., $I_{C1}=I_{C2}=I_C$), the drop across resistor R1 is given by the following equation (4):

$$I_CR1=Vt\ In(I_C/I_{S2})-Vt\ In(I_C/I_{S1})+(1/A)V_C, \tag{4}$$

where A is the open loop gain of the amplifier 14. The currents $I_C$ are thus given by the following equation (5):

$$I_C=(V_i/R1)*InN+(1/R1*A)*V_C, \tag{5}$$

where N is given by equation (6):

$$N=I_{S1}/I_{S2}. \tag{6}$$

From FIG. 1, it is noted that the output voltage $V_{BG}$ is given by the following equation (7):

$$V_{BG}=I_CR2+V_+, \tag{7}$$

and that $V_+$ is given by equation (8):

$$V_+=V_-+(1/A)V_C. \tag{8}$$

Substituting equations (5) and (8) into equation (7), gives the following equation (9) for the output $V_O$:

$$V_{BG} = \frac{R2}{R1} V_T \ln N + \frac{R2}{R1A} V_c + V + \frac{1}{A} V_c \tag{9}$$

The bandgap output is thus given by equation (10):

$$V_{BG} = \frac{R2}{R1} V_T \ln N + V_T \ln \frac{I_C}{I_{S2}} + \left(\frac{R2}{R1} + 1\right) \frac{V_C}{A} \tag{10}$$

The susceptibility of the circuit 10 of FIG. 1 to supply voltage ripple can be expressed as the power supply ripple rejection (PSRR) of the output voltage $V_{BG}$, which is expressed according to the partial derivative of equation (10) with respect to the supply voltage $V_{BAT}$, as given in the following equations (11)–(13):

$$\frac{\partial V_{BG}}{\partial V_{BAT}} = \left(\frac{R2}{R1} + 1\right) \frac{1}{A} \frac{\partial V_C}{\partial V_{BAT}} + \frac{\partial}{\partial V_{BAT}} \left(V_T \ln \frac{I_C}{I_{S2}}\right); \tag{11}$$

$$V_C = V_{BAT} - V_{TP} - \sqrt{\frac{2I_c}{\beta_{PMOS}}}\text{; and} \tag{12}$$

$$\frac{\partial V_C}{\partial V_{BAT}} = 1 - \frac{\partial}{\partial V_{BAT}} \left(\sqrt{\frac{2I_c}{\beta_{PMOS}}}\right), \tag{13}$$

where $V_{TP}$ is the threshold voltage of the PMOS transistors M1 and M2, and $\beta_{PMOS}$ is the constant $\mu_o C_{ox} W/L$ of M1 and M2 (where $\mu_o$ is the mobility constant, $C_{ox}$ is the oxide capacitance, and W/L is the aspect ratio of M1 and M2). The resulting power supply ripple rejection PSRR for the bandgap circuit 10 of FIG. 1 is thus given by the following equation (14):

$$\frac{\partial V_{BG}}{\partial V_{BAT}} = \left(\frac{R2}{R1} + 1\right) \frac{1}{A} - \left(\frac{R2}{R1} + 1\right) \frac{1}{A} \frac{\partial}{\partial V_{BAT}} \left(\sqrt{\frac{2I_c}{\beta_{PMOS}}}\right) + \frac{\partial}{\partial V_{BAT}} \left(V_T \ln \frac{I_c}{I_{s2}}\right). \tag{14}$$

Thus, it is noted in FIG. 1 that as ripple voltages or other undesirable components (e.g., switching noise, etc.) appear on the supply voltage $V_{BAT}$, corresponding noise appears at the bandgap output node $V_{BG}$. This is because the control signal $V_C$ is maintained at a constant equilibrium value while $V_{BAT}$ varies with the ripple voltage. Consequently, the source to gate voltage ($V_{SG}$) of the PMOS transistors M1 and M2 changes, whereby the currents $I_{C1}$ and $I_{C2}$ are affected by the ripple voltage component of the supply voltage $V_{BAT}$, causing a corresponding ripple voltage at the bandgap output terminal $V_{BG}$ (e.g., since the bandgap output voltage $V_{BG}$ is a function of the current $I_{C1}$).

It is also noted that the first term of the PSRR equation (14) is related to the ratio of the resistors R1 and R2, as well as the open loop gain A of the amplifier 14. In order to reduce the susceptibility of the circuit with respect to power supply ripple (e.g., to increase the PSRR), the gain A may be increased by redesign of the amplifier 14. However, for existing bandgap designs, this may be difficult or impractical. For example, increasing the open-loop gain A causes a corresponding increase in the bandwidth of the amplifier 14. As a result, filtering capacitors (not shown) may need to be added to maintain stability of the amplifier 14. This is undesirable as the added capacitor devices occupy a relatively large area in an integrated circuit chip. In addition, it may be desirable to provide an improvement to the PSRR of existing bandgap circuit designs with little intrusion into existing components, such as the amplifier 14.

Furthermore, power supply voltage levels (e.g., $V_{BAT}$) for bandgap circuits such as circuit 10 of FIG. 1 are becoming lower, particularly in association with portable, battery operated devices (e.g., wireless communications devices, portable computers, and the like). For instance, the voltage $V_{BAT}$ supplied by the battery 12 may be 1.3 volts DC, while the bandgap output reference voltage $V_{BG}$ may be about 1.2 volts DC. Thus, there is limited voltage headroom available for other ripple reduction components, such as cascode devices serially connected in the circuit branches 21 and 22. Consequently, a need exists for improvements over the bandgap circuit 10 of FIG. 1 with respect to increasing PSRR, without violating voltage headroom constraints in low power, low voltage applications, while adding minimal components. Moreover, it is desirable in such applications to provide improved PSRR without significantly increasing power consumption.

As illustrated and described in greater detail below, the present invention provides such advantages by improving the PSRR for bandgap reference circuits or systems, without employing cascode or other devices which may impinge upon voltage headroom limitations, and without causing significant increase in physical component space, component count, circuit complexity, or power consumption. Moreover, the present invention allows improvement in existing bandgap designs without requiring redesign of amplifiers therein.

Figure 2:
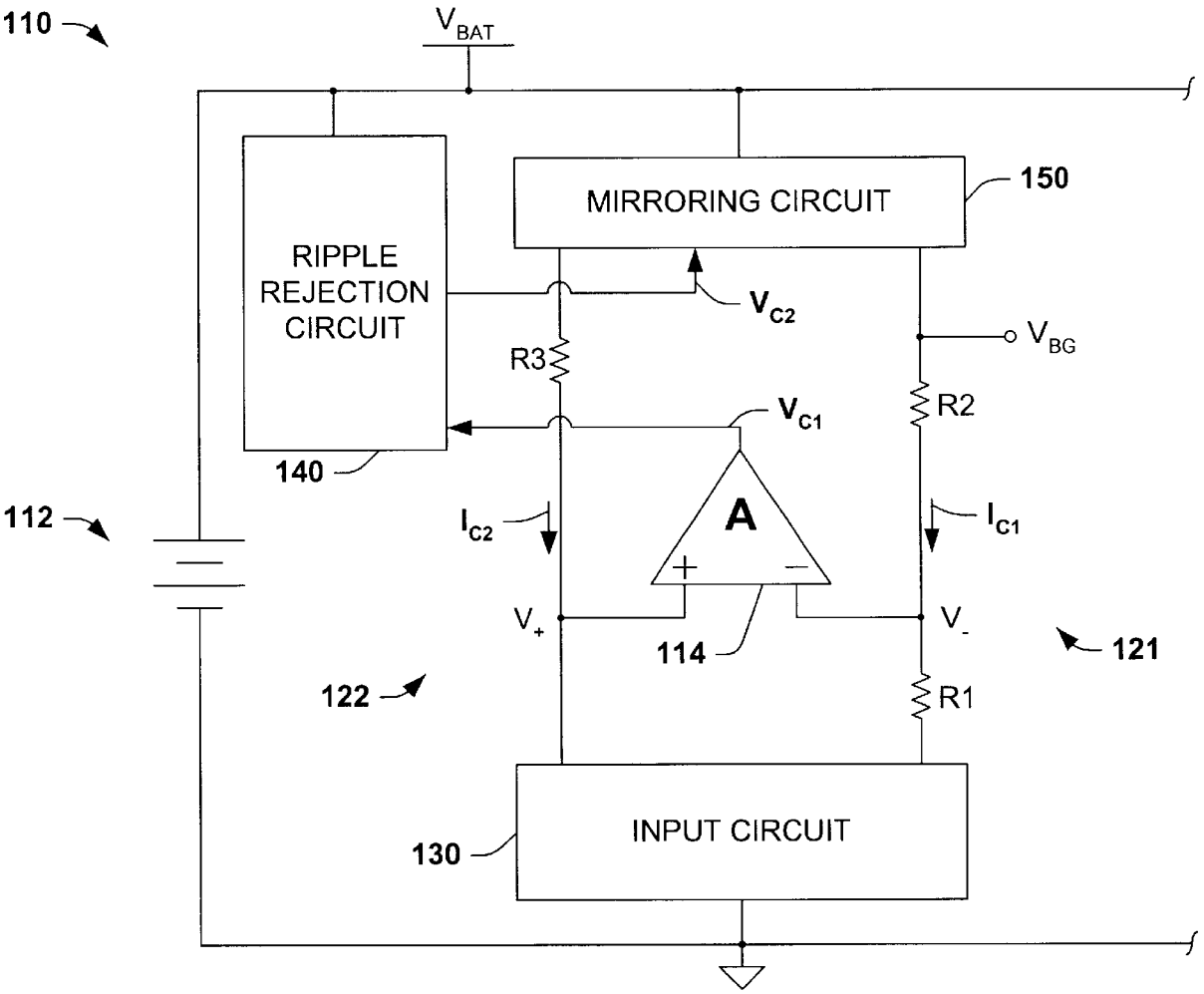
FIG. 2 is a schematic diagram illustrating an exemplary bandgap circuit and a ripple rejection circuit therefore in accordance with one or more aspects of the present invention.

An exemplary bandgap circuit or system 110 is illustrated in FIG. 2, comprising a battery 112 supplying a voltage $V_{BAT}$, which may be of any voltage value, such as about 1.3 volts DC in a low power or low voltage application of the circuit 110. The circuit 110 comprises first and second circuit branches 121 and 122 electrically connected between the supply voltage $V_{BAT}$ and ground, and having first and second input voltage nodes $V_-$ and $V_+$, respectively. The circuit 110 further comprises with an input circuit 130, an amplifier 114, a ripple rejection circuit 140, and a mirroring circuit 150. The input circuit 130 provides input voltages at the nodes $V_-$ and $V_+$, for example, which may represent first and second base-emitter voltages in the circuit 110. The amplifier 114 may be an op-amp, which senses the input voltages at the nodes $V_+$ and $V_-$ and provides a first control signal $V_{C1}$ representative of a difference between the first and second input voltages.

The ripple rejection circuit 140 receives the signal $V_{C1}$ and provides a second control signal $V_{C2}$ representative of the difference between the supply voltage $V_{BAT}$ and $V_{C1}$. The mirroring circuit 150 provides currents $I^{C1}$ and $I_{C2}$ (hereinafter collectively referred to as $I_C$) to the circuit branches 121 and 122, respectively, according to the signal $V_{C2}$, wherein the current $I_{C1}$ provides a bandgap reference voltage output at a reference voltage node $V_{BG}$ in the first circuit branch 121. Because the ripple rejection circuit 140 generates the signal $V_{C2}$ based on the difference between the supply voltage $V_{BAT}$ and $V_{C1}$, any ripple voltage components or noise components (e.g., AC variations superimposed on the DC voltage provided by the battery 112) in the $V_{BAT}$ supply voltage are accounted for in the second control signal $V_{C2}$. Consequently, the currents $I_C$ provided by the mirroring circuit 150 are stabilized with respect to the ripple components, and the resulting reference voltage output at the node $V_{BG}$ is stable (e.g., the PSRR of the circuit 110 is improved compared with that of the circuit 10 of FIG. 1).

Figure 3A:
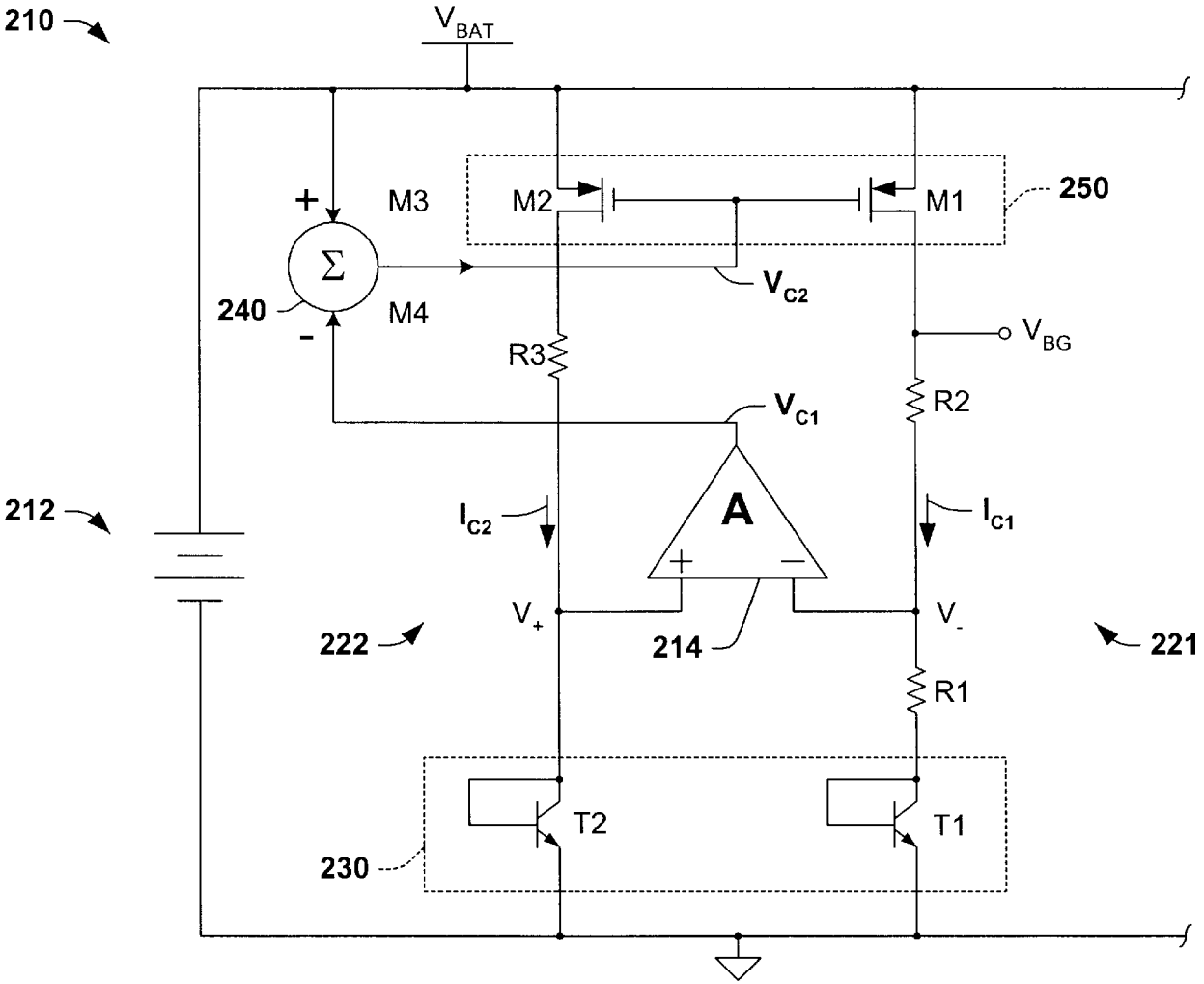
FIG. 3*a* is a schematic diagram illustrating another bandgap reference with a summer type ripple rejection circuit in accordance with the invention.
Figure 3B:
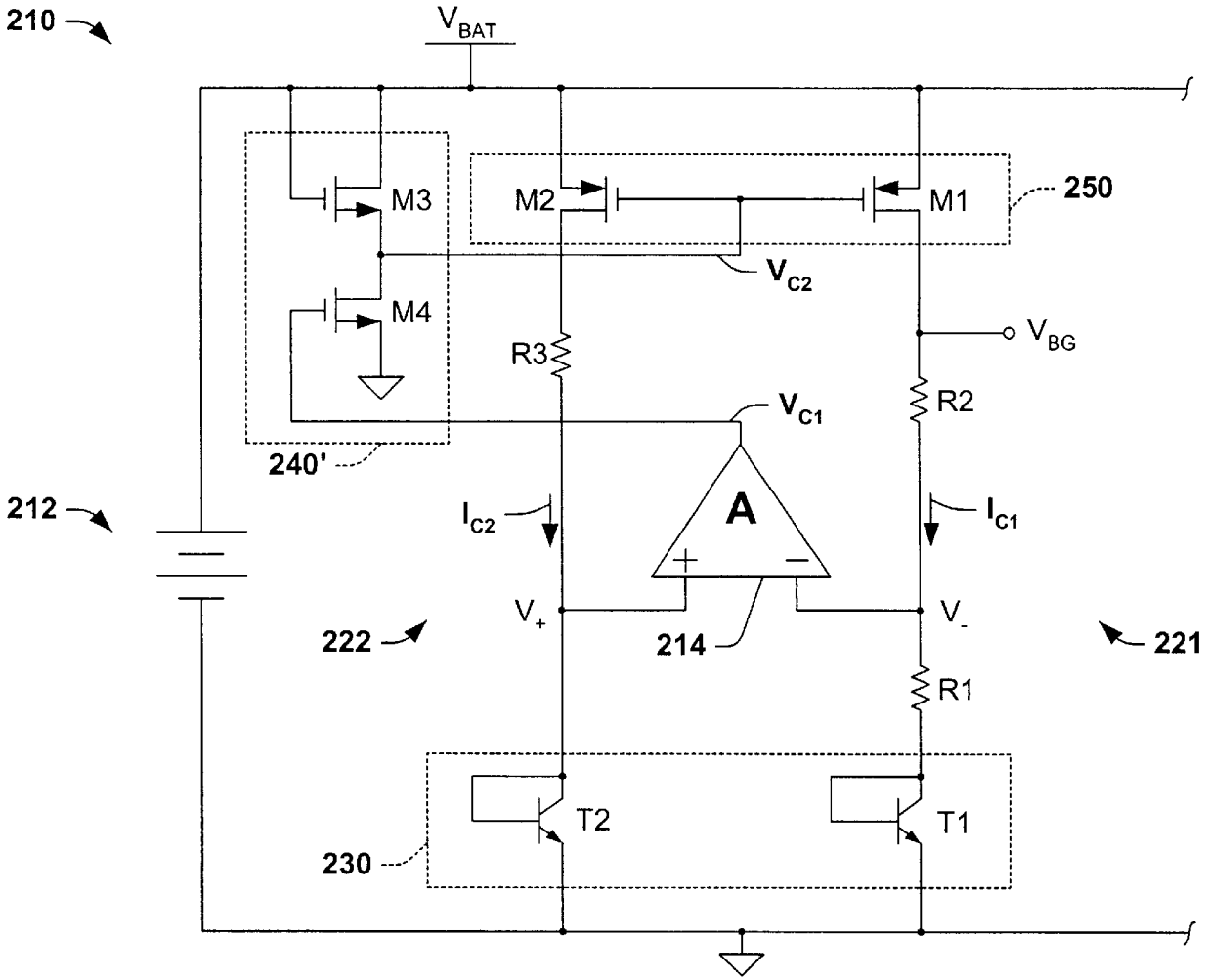
FIG. 3*b* is a schematic diagram illustrating another bandgap reference with a summer type ripple rejection circuit comprising two bipolar devices in accordance with the invention.
Figure 4:
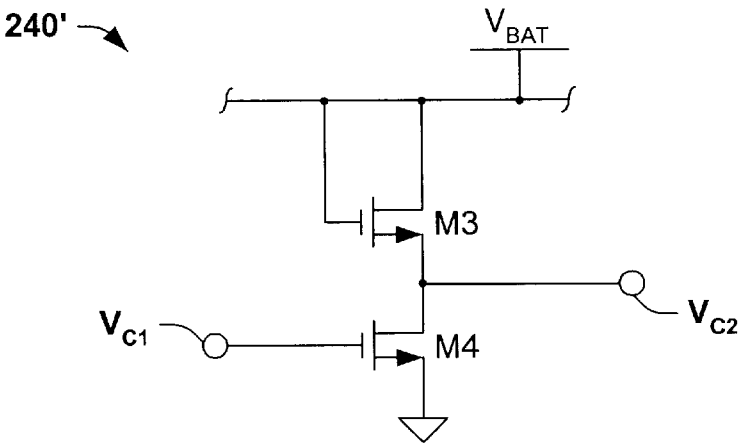
FIG. 4 is a schematic diagram illustrating further details of the ripple rejection circuit of FIG. 3*b;*

Referring now to FIGS. 3*a*, 3*b*, and 4, a detailed illustration is provided of another exemplary bandgap circuit or system 210 in accordance with the present invention. The system 210 comprises a battery 212, which generates a supply voltage $V_{BAT}$, as well as first and second circuit branches 221 and 222 electrically connected between the supply voltage $V_{BAT}$ and ground, with first and second input voltage nodes $V_-$ and $V_+$, respectively. The circuit 220 further comprises an input circuit 230, an amplifier 214, a ripple rejection circuit 240, and a mirroring circuit 250. The input circuit 230 provides input voltages at the nodes $V_-$ and $V_+$ representing base-emitter voltages of diode-connected bipolar transistors T1 and T2 therein. The amplifier 214 senses the input voltages at the nodes $V_-$ and $V_+$ and generates a first control signal $V_{C1}$ representative of the difference therebetween.

The ripple rejection circuit 240, in turn, provides a second control signal $V_{C2}$ representing the difference between the supply voltage $V_{BAT}$ and the first control signal $V_{C1}$. Thus, the circuit 240 comprises a summation circuit, which functions as a subtractor, to generate the control signal $V_{C2}$ as the difference between the supply voltage $V_{BAT}$ and the first control signal $V_{C1}$. The mirroring circuit 250 provides currents $I_{C1}$ and $I_{C2}$ to the circuit branches 221 and 222, respectively, according to the second control signal $V_{C2}$, wherein the current $I_{C1}$ provides a bandgap reference voltage output at a reference voltage node $V_{BG}$ in the first circuit branch 221. In the circuit 210, the bandgap reference voltage at the node $V_{BG}$ is thus $V_{BE1}+I^{C1}*(R1+R2)$. The amplifier 214 comprises an op-amp which operates in closed-loop fashion to maintain the input nodes $V_+$ and $V_-$ at the same potential (e.g., the base-emitter voltage $V_{BE2}$ of transistor T2). The resistor values for R2 and R3 are equal, such as between 50 KOHMS and 150 KOHMS, where R1 may be about 10 KOHMS in the illustrated implementation.

As further illustrated and described below with respect to FIGS. 3*b* and 4, the ripple rejection circuit 240 generates the signal $V_{C2}$ based on the difference between the supply voltage $V_{BAT}$ and $V_{C1}$, so that ripple voltage components or noise in the $V_{BAT}$ supply voltage are accounted for in the second control signal $V_{C2}$. As a result, the currents $I_C$ provided by the mirroring circuit 250 are stabilized with respect to the ripple components, and the resulting reference voltage output at the node $V_{BG}$ is stable. The input circuit 230 comprises two diode-connected bipolar transistors T1 and T2 having different emitter areas or sizes, whereby the base-emitter voltages thereof are different when equal currents $I_{C1}$ and $I_{C2}$ flow through the circuit branches 221 and 222. The currents $I_{C1}$ and $I_{C2}$ are made equal by the configuration of two PMOS type transistors M1 and M2 in the mirroring circuit 250, where the gates of the PMOS devices M1 and M2 are driven by the second control signal $V_{C2}$.

The first circuit branch 221 comprises first and second resistors R1 and R2 with R2 connected between the $V_-$ input voltage node and the bandgap reference voltage output node $V_{BG}$. The resistor R1 is connected between the $V_-$ node and the transistor T1. A first MOS transistor M1 (e.g., PMOS) is connected in the first circuit branch 221 between the supply voltage $V_{BAT}$ and the bandgap output node $V_{BG}$ so as to provide the first branch current $I_{C1}$ in a controlled fashion according to a control signal $V_{C2}$ at the gate terminal thereof. The second circuit branch 222 comprises a third resistor R3 connected between a second MOS transistor M2 (e.g., PMOS) and the second bipolar transistor T2 (e.g., at node $V_+$), wherein the transistor M2 delivers a second branch current $I_{C2}$ according to the second control signal $V_{C2}$. The amplifier 214 has a non-inverting input terminal connected to the $V_+$ input voltage node in the second branch 222 and an inverting input terminal connected to the $V_-$ input voltage node in the first branch 221.

Figure 5:
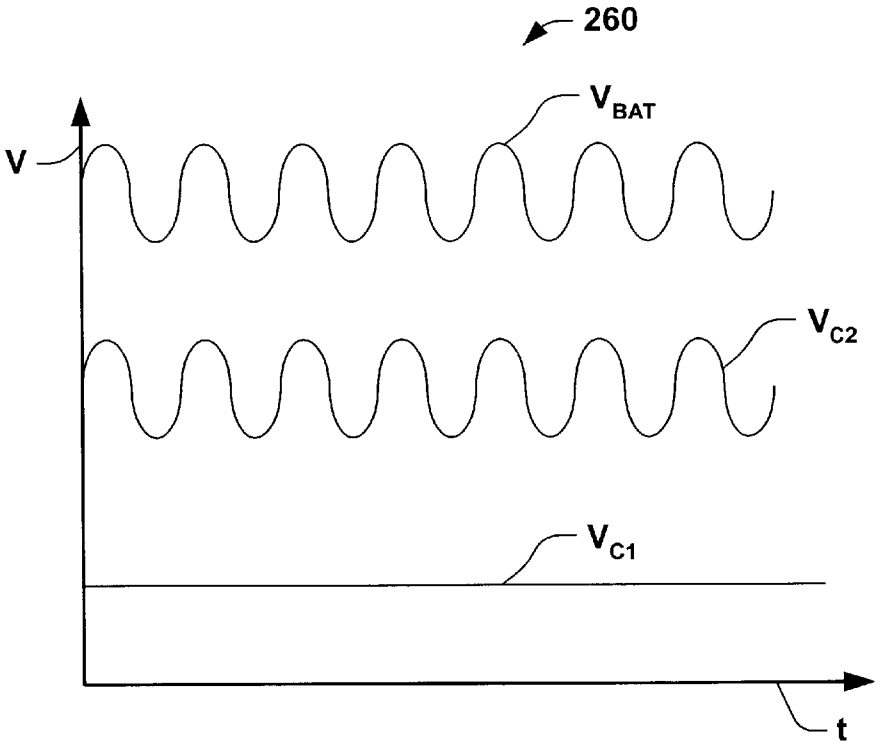
FIG. 5 is a graph illustrating the relationship between first and second control signals and a supply ripple voltage in the ripple rejection circuit of FIGS. 3*a*–4.

Unlike the circuit 10 of FIG. 1, the amplifier 214 does not directly control the operation of the PMOS devices M1 and M2. Rather, the amplifier 214 provides the first control signal $V_{C1}$ at an output terminal according to the difference between the voltages $V_+$ and $V_-$ as well as an open-loop gain A, wherein the control signal $V_{C1}=A(V_+-V_-)$ by virtue of the feedback through resistors R2 and R3. The signal $V_{C1}$ is then provided to the ripple rejection circuit 240, where the second control signal $V_{C2}$ (e.g., driving the PMOS gates of M1 and M2) is generated according to the difference between the first control signal $V_{C1}$ and the supply voltage $V_{BAT}$. Because the signal $V_{C2}$ driving the PMOS devices M1 and M2 accounts for ripple or other variations in the supply voltage $V_{BAT}$, the reference voltage output at the node $V_{BG}$ is relatively free from ripple effects, as illustrated in a graph 260 of FIG. 5. Thus, the illustrated implementation of the invention provides significantly increased PSRR compared with the convention circuit 10 of FIG. 1.

It is further noted that the improved PSRR in the circuit 210 is not derived by redesigning the amplifier 214 to increase the open-loop gain A thereof. Consequently, the invention does not suffer from the bandwidth increase associated with increased open-loop gain, and accordingly no additional filtering capacitors are required to keep the amplifier 214 stable. Also, the addition of the ripple rejection circuit 240 does not significantly increase the space or power consumption of the bandgap circuit 210 compared with convention bandgap circuits. For instance, in the implementation 210 of FIG. 3*b*, the ripple rejection circuit 240' comprises only two additional NMOS type transistors M3 and M4, when compared to the circuit 10 of FIG. 1. Furthermore, the circuit 210 is applicable in low power low voltage systems, in which voltage supply headroom is at a premium. In this regard, it is noted that the ripple rejection circuit 240' of FIG. 3*b* is not position within either of the circuit branches 221 or 222, whereby the voltage headroom of the circuit 210 is not larger than that of the conventional circuit 10 of FIG. 1.

As illustrated in FIG. 4, the second control signal $V_{C2}$ is provided by the middle of the two NMOS devices M3 and M4 in the circuit 240', and is equal to the power supply voltage $V_{BAT}$ minus the first control signal $V_{C1}$ coming from the op-amp 214. The upper NMOS M3 is diode connected between $V_{C2}$ and $V_{BAT}$. The gate terminal of the lower NMOS M4 is connected to the op-amp output $V_{C1}$. As illustrated below, the second control signal voltage $V_{C2}$ (e.g., provided to the PMOS gates of M1 and M2 in FIG. 3*b*is equal to the gate voltage ($V_{BAT}$) of M3 minus the gate voltage $V_{C1}$ of the lower NMOS M4 in the ripple rejection circuit 240.

In operation, the circuit 210 provides a bandgap reference output voltage at the node $V_{BG}$ which is generally stable with respect to temperature variations as well as with respect to supply voltage noise or ripple. The ripple rejection circuit 240' provides the signal $V_{C2}$ to the gates of the PMOS transistors M1 and M2 in the mirroring circuit 250, by which the currents $I^{C1}$ and $I_{C2}$ in the first and second circuit branches 221 and 222 are equal. The second input voltage at node $V_+$ represents a base-emitter voltage $V_{BE2}$ associated with the diode-connected transistor T2, which varies with temperature and is generally proportional to the absolute temperature in degrees Kelvin. The amplifier 214 operates in closed-loop fashion to make the voltages at $V_+$ and $V_-$ equal, such that $V_+=V_{BE2}=V_-=V_{BE1}+I_{C1}*R1$ in equilibrium (assuming the loop-gain is infinitely large, otherwise $V_+=V_-+V_{C1}/A$). Thus, the output reference voltage $V_{BG}=V_-+I_{C1}*R2=V_{BE1}+I_{C1}*(R1+R2)$.

The ripple rejection of the bandgap reference circuit 210 is thus improved over conventional approaches, such as the circuit 10 of FIG. 1. In order to appreciate the relative independence of the bandgap reference output $V_{BG}$ from noise on the supply voltage $V_{BAT}$, it is noted in the circuit 210 that since the currents $I_{C1}$ and $I_{C2}$ are equal at equilibrium (e.g., due to operation of the amplifier 214), the first input voltage $V_-$ is given by the following equation (15):

$$V_-=V_+-(1/A)V_{C1}=Vt\ In(I_C/I_{S2})-(1/A)V_{C1}=I_{C1}R1+V_{BE1}=I_{C1}R1+Vt\ In(I_{C1}/I_{S1}), \quad (15)$$

where $I_{S1}$ is the saturation current of the transistor T1. Letting $N=I_{S1}/I_{S2}$, the currents $I^{C1}$ and $I_{C2}$ (herein after collectively $I_C$) are given by the following equation (16):

$$I_c = \frac{1}{R1} Vt \ln N - \frac{1}{R1}\frac{1}{A} V_{C1}. \quad (16)$$

The bandgap reference output voltage VBG is given by the following equation (17):

$$V_{BG}=I_C R2+V_-. \quad (17)$$

Substituting equation (16) into equation (17) provides the output voltage $V_{BG}$ according to the following equation (18):

$$V_{BG}=(R2/R1)Vt\ In\ N-(R2/R1)(V_{C1}/A)+V_-=(R2/R1)Vt\ In\ N+Vt\ In(I_C/I_{S2})-(1+(R2/R1))(V_{C1}/A). \quad (18)$$

As shown in FIGS. 3*b* and 4, assuming M3 and M4 have the same threshold voltage($V_{TN}$), the current through the ripple rejection circuit components M3 and M4 is given by the following equation (19):

$$\frac{\beta_3}{2}(V_{BAT}-V_{C2}-V_{TN})^2=\frac{\beta_4}{2}(V_{C1}-V_{TN})^2, \quad (19)$$

where $\beta_3$ and $\beta_4$ are the constants $(\mu_o C_{ox} W/L)_{i=3,4}$. Thus, the second control signal voltage $V_{C2}$ is given by the following equation (20):

$$V_{C2}=V_{BAT}-\sqrt{\frac{\beta_3}{\beta_4}}V_{C1}+\left(\sqrt{\frac{\beta_3}{\beta_4}}-1\right)V_{TN} \quad (20)$$

also, $$V_{C2}=V_{BAT}-V_{TP}-\sqrt{\frac{2I_C}{\beta_P}}.$$

The first control signal voltage $V_{C1}$ is given by the following equation (21):

$$V_{C1}=\sqrt{\frac{\beta_3}{\beta_4}}V_{TP}+\left(1-\sqrt{\frac{\beta_3}{\beta_4}}\right)V_{TN}+\sqrt{\frac{\beta_3 2I_C}{\beta_4\beta_P}}. \quad (21)$$

It is noted from equation (21) above that the expression for the first control signal $V_{C1}$ does not include a supply voltage term (e.g., $V_{BAT}$). By substituting equation (21) into equation (18), the partial derivative of equation (18) with respect to the supply voltage $V_{BAT}$ is indicative of the power supply ripple rejection capabilities of the exemplary bandgap circuit 210 of FIGS. 3*b* and 4 and is expressed by the following equation (22):

$$\frac{\partial V_{BG}}{\partial V_{BAT}}=\left(\frac{R2}{R1}+1\right)\frac{1}{A}\frac{\partial}{\partial V_{BAT}}\left(\sqrt{\frac{2I_C}{\beta_P}\frac{\beta_3}{\beta_4}}\right)+\frac{\partial}{\partial V_{BAT}}\left(Vt\ \ln\frac{I_C}{I_{S1}}\right). \quad (22)$$

Referring now to equations (14) and (22) it is noted that the term (1+(R2/R1))(1/A) from the conventional circuit 10 of FIG. 1 (e.g., as in equation (14)), is not present in the equation (22). Thus, it is seen that the present invention provides improved PSRR compared with convention designs, without regard to the open-loop gain A of the amplifier 214.

Figure 6:
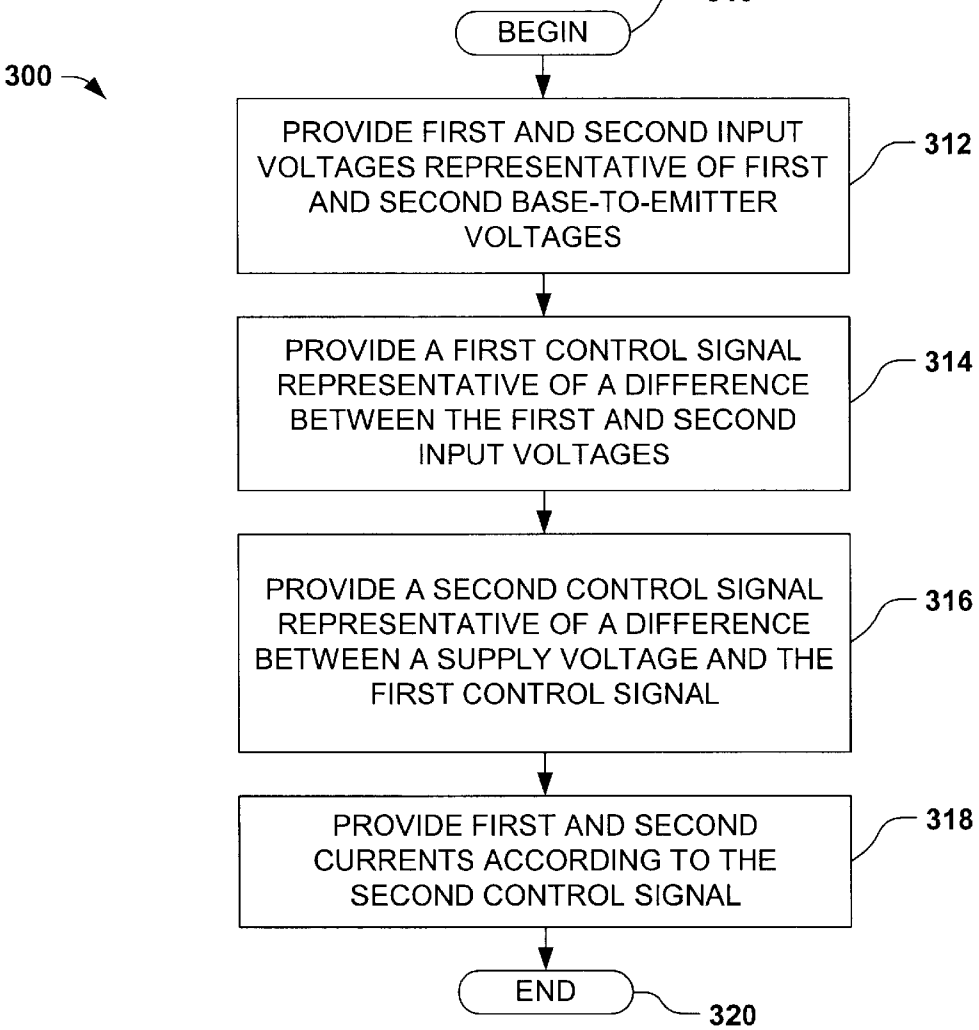
FIG. 6 is a flow diagram illustrating an exemplary method of reducing ripple voltages in a bandgap voltage reference system according to another aspect of the present invention.

Another aspect of the invention relates to methodologies for reducing ripple voltage in a bandgap voltage reference system. One such method 300 is illustrated and described hereinafter with respect to FIG. 6. Although the exemplary method 300 is illustrated and described hereinafter as a series of acts or events, it will be appreciated that the present invention is not limited by the illustrated ordering of such acts or events, as some acts may occur in different orders and/or concurrently with other acts or events apart from those illustrated and/or described herein, in accordance with the invention. In addition, not all illustrated steps may be required to implement a methodology in accordance with the present invention. Furthermore, the methods according to the present invention may be implemented in association with the apparatus and systems illustrated and described herein as well as in association with other systems not illustrated.

Beginning at 310, the method 300 comprises providing first and second input voltages representative of first and second base-emitter voltages in the system at 312 and providing a first control signal (e.g., such as signal $V_{C1}$ of FIG. 3*b* at 314, representative of a difference between the first and second input voltages. At 316, a second control signal (e.g., such as $V_{C2}$ in FIGS. 3*b* and 4 above) is provided representative of a difference between a supply voltage (e.g., $V_{BAT}$) and the first control signal. At 318, first and second currents are provided according to the second control signal. The first and second currents (e.g., such as $I_{C1}$ and $I_{C2}$ above) can thus be used to providing a reference voltage (e.g., such as bandgap output voltage $V_{BG}$ above) according to the second control signal. The provision of the first control signal at 314 may involve subtracting or obtaining a difference between the first and second input voltages, amplifying the difference, and providing the first control signal according to the amplified difference.

In one implementation, the second control signal may be provided at 316 through connecting a drain terminal and a gate terminal of a first MOS transistor (e.g., such as the NMOS transistor M3 of FIGS. 3*b* and 4) to the supply voltage, connecting a source terminal of the first MOS transistor and a drain terminal of a second MOS transistor (e.g., NMOS transistor M4) to a mirroring circuit (e.g., mirroring circuit 250) in the system, connecting a gate terminal of the second MOS transistor to receive the first control signal, connecting a source terminal of the second transistor to ground, and providing the second control signal at the source terminal of the first MOS transistor and the drain terminal of the second MOS transistor representative of a difference between the supply voltage and the first control signal. Furthermore, the provision of the first control signal may comprise providing a voltage to the gate terminal of the second MOS transistor representative of a difference between first and second bandgap voltages in the bandgap voltage reference system.

Although the invention has been illustrated and described with respect to one or more implementations, equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means") used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description and the claims, such terms are intended to be inclusive in a manner similar to the term "comprising."

What is claimed is:

1. A bandgap circuit for providing a reference voltage, comprising:

first and second circuit branches electrically connected between a supply voltage and a ground, the first circuit branch comprising a first input voltage node and a reference voltage node, and the second circuit branch comprising a second input voltage node;

an input circuit connected to the first and second circuit branches and providing first and second input voltages at the first and second input voltage nodes, respectively;

an amplifier having first and second input terminals connected to the first and second input voltage nodes, respectively, and an amplifier output terminal providing a first control signal representative of a difference between the first and second input voltages;

a ripple rejection circuit connected to the supply voltage and the amplifier output terminal and providing a second control signal representative of a difference between the supply voltage and the first control signal; and a mirroring circuit connected to the ripple rejection circuit and providing first and second currents to the first and second circuit branches, respectively, according to the second control signal, the first current providing the reference voltage at the reference voltage node.

2. The bandgap circuit of claim 1, wherein the first circuit branch comprises first and second resistors, the first resistor being connected between the first input voltage node and the input circuit, and the second resistor being connected between the first input voltage node and the reference voltage node, and wherein the second circuit branch comprises a third resistor connected between the mirroring circuit and the second input voltage node.

3. The bandgap circuit of claim 1, wherein the input circuit comprises first and second diode-connected transistors connected in the first and second circuit branches, respectively.

4. The bandgap circuit of claim 3, wherein the first and second diode-connected transistors are bipolar transistors having first and second collector terminals and first and second base terminals connected to the first and second circuit branches, respectively, and first and second emitter terminals connected to the ground, wherein the first and second input voltages are representative of first and second base to emitter voltages associated with the first and second diode-connected transistors, respectively, and wherein the first and second diode-connected transistors have different emitter sizes.

5. The bandgap circuit of claim 1, wherein the amplifier comprises an op-amp, the first input terminal being an inverting input and the second input terminal being a non-inverting input.

6. The bandgap circuit of claim 1, wherein the mirroring circuit comprises first and second MOS transistors connected to the first and second circuit branches, respectively, the first and second MOS transistors having first and second gate terminals, respectively, connected to the ripple rejection circuit and receiving the second control signal therefrom, wherein the first and second MOS transistors provide the first and second currents to the first and second circuit branches, respectively, according to the second control signal.

7. The bandgap circuit of claim 6, wherein the first and second MOS transistors comprise PMOS transistors.

8. The bandgap circuit of claim 1, wherein the ripple rejection circuit comprises third and fourth MOS transistors providing the second control signal representative of the difference between the supply voltage and the first control signal.

9. The bandgap circuit of claim 8, wherein the third MOS transistor comprises a drain terminal connected to the supply voltage, a gate terminal connected to the supply voltage, and a source terminal connected to the mirroring circuit, and wherein the fourth MOS transistor comprises a drain terminal connected to the source terminal of the third MOS transistor, a gate terminal connected to the amplifier output terminal, and a source terminal connected to the ground.

10. The bandgap circuit of claim 9, wherein the third and fourth MOS transistors comprise NMOS transistors.

11. The bandgap circuit of claim 8, wherein the first circuit branch comprises first and second resistors, the first resistor being connected between the first input voltage node and the input circuit, and the second resistor being connected between the first input voltage node and the reference voltage node, and wherein the second circuit branch comprises a third resistor connected between the mirroring circuit and the second input voltage node.

12. The bandgap circuit of claim 8, wherein the mirroring circuit comprises first and second MOS transistors connected to the first and second circuit branches, respectively, the first and second MOS transistors having first and second gate terminals, respectively, connected to the ripple rejection circuit and receiving the second control signal therefrom, wherein the first and second MOS transistors provide the first and second currents to the first and second circuit branches, respectively, according to the second control signal.

13. The bandgap circuit of claim 12, wherein the input circuit comprises first and second diode-connected bipolar transistors connected in the first and second circuit branches, respectively, wherein the amplifier comprises an op-amp, the first input terminal being an inverting input and the second input terminal being a non-inverting input, wherein the first and second MOS transistors comprise PMOS transistors, and wherein the third and fourth MOS transistors comprise NMOS transistors.

14. The bandgap circuit of claim 12, wherein the third MOS transistor comprises a drain terminal connected to the supply voltage, a gate terminal connected to the supply voltage, and a source terminal connected to the mirroring circuit, and wherein the fourth MOS transistor comprises a drain terminal connected to the source terminal of the third MOS transistor, a gate terminal connected to the amplifier output terminal, and a source terminal connected to the ground.

15. A system for reducing output ripple voltages in a bandgap voltage reference circuit, comprising:

a first MOS transistor comprising:

a first drain terminal connected to a supply voltage in the bandgap voltage reference circuit, a first gate terminal connected to the supply voltage, and a first source terminal providing a control signal to a mirroring circuit in the bandgap voltage reference circuit; and a second MOS transistor comprising:

a second drain terminal connected to the first source terminal of the first MOS transistor, a second gate terminal connected to an amplifier in the bandgap voltage reference circuit and receiving an amplifier signal representative of a difference between first and second bandgap voltages in the bandgap voltage reference circuit from the amplifier, and a second source terminal connected to a ground;

wherein the control signal is representative of a difference between the supply voltage and the amplifier signal.

16. The system of claim 15, wherein the first and second MOS transistors comprise NMOS transistors.

17. A method of reducing ripple voltage in a bandgap voltage reference system, comprising:

providing first and second input voltages representative of first and second emitter-to-base voltages in the system;

providing a first control signal representative of a difference between the first and second input voltages;

providing a second control signal representative of a difference between a supply voltage and the first control signal; and providing a reference voltage according to the second control signal.

18. The method of claim 17, wherein providing the reference voltage comprises providing first and second currents in first and second circuit branches in the bandgap voltage reference system according to the second control signal.

19. The method of claim 17, wherein providing the first control signal comprises;

subtracting a first one of the first and second input voltages from another of the first and second input voltages;

amplifying the difference between the first and second input voltages; and providing the first control signal according to an amplified difference between the first and second input voltages.

20. The method of claim 17, wherein providing the second control signal comprises:

connecting a drain terminal and a gate terminal of a first MOS transistor to the supply voltage;

connecting a source terminal of the first MOS transistor and a drain terminal of a second MOS transistor to a mirroring circuit in the bandgap voltage reference system;

connecting a gate terminal of the second MOS transistor to receive the first control signal;

connecting a source terminal of the second transistor to a ground in the system; and providing the second control signal at the source terminal of the first MOS transistor and the drain terminal of the second MOS transistor representative of a difference between the supply voltage and the first control signal.

21. The method of claim 20, wherein providing the first control signal representative of a difference between the first and second input voltages comprises providing a voltage to the gate terminal of the second MOS transistor representative of a difference between first and second bandgap voltages in the bandgap voltage reference system.

* * * * *